United States Patent [19]

Dancsó et al.

[11] 4,134,350

[45] Jan. 16, 1979

[54] COMBINED BUTTON STITCHING AND SEWING MACHINE

[75] Inventors: László Dancsó; Olivér Kocsis; Jenö Horváth, all of Budapest; Miklós Bánszki, Gyöngyös, all of Hungary

[73] Assignee: Csepel Müvek Jármü És Konfekciópari Gépgyára, Budapest, Hungary

[21] Appl. No.: 796,886

[22] Filed: May 16, 1977

[30] Foreign Application Priority Data

May 18, 1976 [HU] Hungary ..... 1088

[51] Int. Cl.[2] ..... D05B 3/14

[52] U.S. Cl. ..... 112/110

[58] Field of Search ..... 112/110, 111, 112, 104, 112/270, 108, 109

[56] References Cited

U.S. PATENT DOCUMENTS

| | | | |
|---|---|---|---|
| 2,391,378 | 12/1945 | Avis | 112/110 |
| 2,739,550 | 3/1956 | Patterson et al. | 112/110 |
| 3,329,111 | 7/1967 | Pedersen et al. | 112/110 |
| 3,807,327 | 4/1974 | Kovacs et al. | 112/110 |

*Primary Examiner*—H. Hampton Hunter

[57] ABSTRACT

Button stitching and sewing machine comprising a control disc with paths to control a needle swinging device and a cloth moving mechanism which is complete with an orienting device. Combined, conjugated control paths of the disc include first main sections for controlling button stitching, second such sections for controlling fixing stitches, and third main path sections for controlling the shank formation. According to the invention, fourth path sections are inserted for controlling through stitches, namely between the second and the third main path sections. Additional, optional features are also disclosed.

5 Claims, 8 Drawing Figures

COMBINED BUTTON STITCHING AND SEWING MACHINE

The invention relates to combined button stitching machines.

In the clothing confection industry several combined button stitching machines became known which perform the blind sewing of the buttons to the material, i.e. forming the loops that connect the buttons to the workpieces and form what is known in the trade as a "shank", without using a passing thread, and wrapping around the shank in a single operation. The common characteristics of these machines lie in that, in the course of the button sewing process, the inner cloth layer is either fixed by every single stitch, resulting in an inevitable wrinkling of that layer, or it is not fixed at all, and as a consequence the inner cloth layer freely floats, again in an undesirable manner. Such button stitching machines are characterized by one that forms the subject matter of the Hungarian Pat. No. 162,224, the counterpart of U.S. Pat. No. 3,807,327 of Apr. 30, 1974 to J. Kovács et al., titled Button Sewing Machine.

In the known constructions the cloth layers to which the buttons are to be stitched and being folded up are oriented by externally induced impacts. The thickness of the cloth layers may vary, even within the same jacket or garment, consequently the relative position of the cloth layers cannot be unambiguously achieved by an external impact. From this the conclusion may be drawn that the fixing of the inner cloth, preferably by a single stitch, cannot be achieved by an external impacting orientation either.

To eliminate the undesirable wrinkling or floating of the inner layer, the use of combined button stitching machines has been proposed, as disclosed in the USA Pat. No. 2,739,550. As a matter of fact, such machines actually simulate the manual sewing of the buttons, being suitable for fixing the lowest cloth layer by a single stitch. However the machine is very expensive on account of its complicated construction and special character. Wearisome and complex manipulations require qualified and skilled workers. In addition, productivity with this machine amounts only to 700 to 800 buttons per shift so that it is not possible to incorporate the machine into a reasonably fast technological production line.

It is a major object of this invention to eliminate the drawbacks described above and to develop a combined button stitching and sewing machine which - after having formed the shank - fixes the inner cloth layer with a single stitch, simultaneously eliminating any wrinkles that are of course inadmissible from the point of view of first-class quality. It is another object to provide a machine that works with an essentially high capacity, the manipulation of which is simpler. Compared to hitherto known solutions, the investition and operating costs of the inventive machine are much lower.

The invention is based on the recognition that the task set can be easily solved when a simultaneously operating path for controlling the stitches is inserted into the control path of the needle swinging device, thereby performing an internal orientation of the cloth layers as they are being folded up. Due to the coordinated travel of the needle and the cloth, the inner cloth layer can be fixed in this case by a single stitch without any wrinkle formation.

The invention constitutes improvements in known combined button stitching and sewing machines that are provided with a control disc having paths for controlling the needle swinging device and the cloth guiding device, complete with an orienting mechanism, the conjugated control paths consisting of main sections for controlling the stitching of the button, of other main sections that perform the fixing stitches, and of yet other main sections for controlling the shank formation.

The improvement and main feature of the invention lies in that a section is inserted for the control of through stitching, between the second- and third-named path sections, that is between the fixing of the stitches and the shank formation.

It has further been found that it is highly desirable that the combined button stitching and sewing machine be so constructed that the section of the path that controls the needle swinging device, which controls the stitching, be shaped with an arch, and an end point of its radius of curvature lie outside an annular bend defined by the inner and outer subsections of the main section that controls the button stitching. Due to the arched surface the work performance is made very easy.

Furthermore, according to additional optional features of the invention, the section that controls the stitching and forms part of the path controlling the cloth movement is also formed with an arch whereas its radius of curvature conforms to one of the radii of curvature that belong to the external and internal subsections of the main path section that controls the button stitching.

The invention thus provides a novel, improved and efficient combined button stitching sewing machine, optionally also including an adjusting device that can regulate the relative position of stationary and moving parts of the orienting mechanism, by the aid of which the internal orientation of the cloth can easily be achieved.

Further objects, features and advantages of the invention will become clear from the following description when considered in conjunction with the accompanying drawings, wherein FIG. 1 is an axonometric and kinematic scheme of an exemplary, preferred embodiment of a combined button stitching sewing machine according to the invention;

Figure 1:
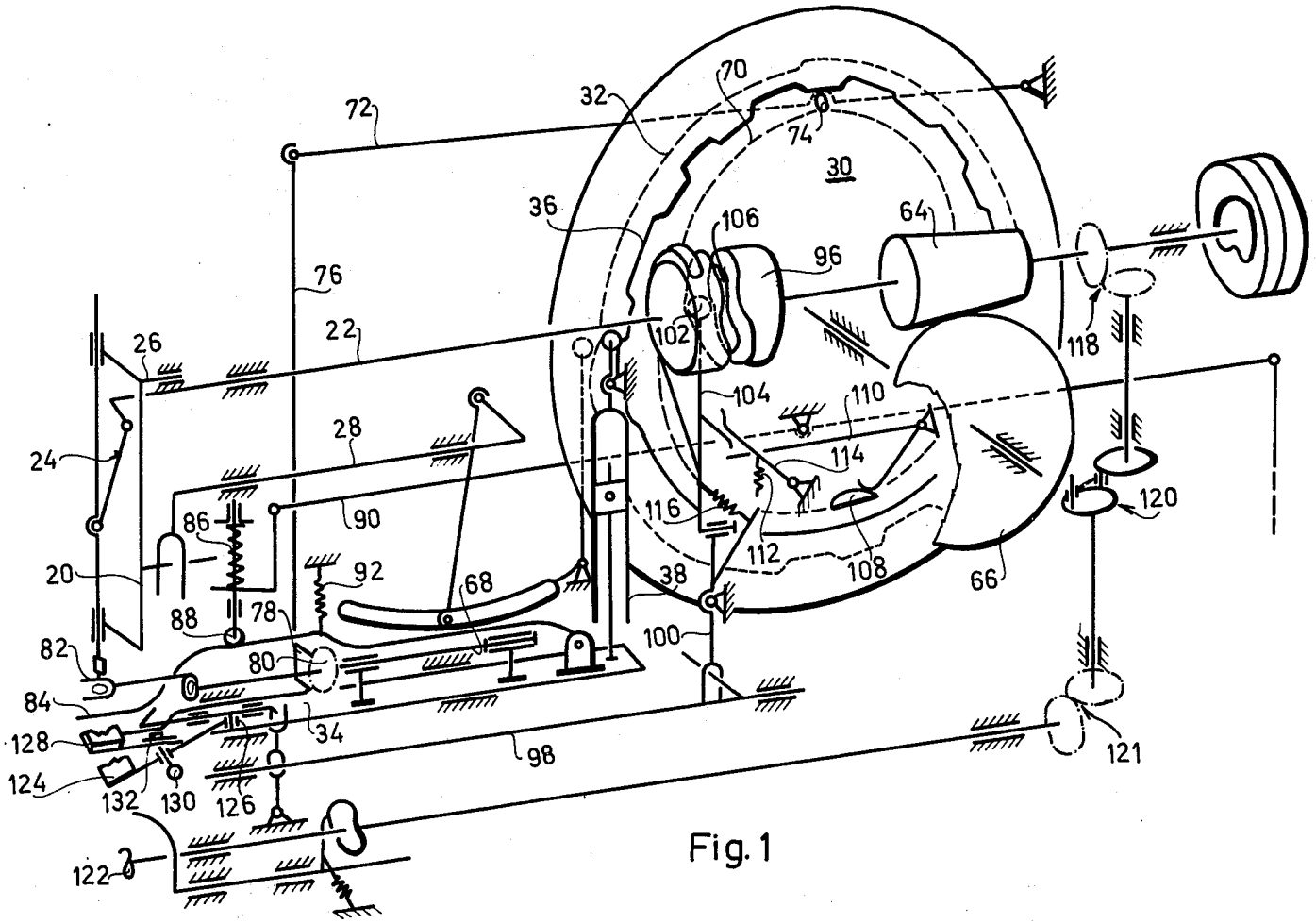

As it can be seen in FIG. 1, a needle bar frame 20 is moved alternately in a known manner by a crank drive 24 formed on the front end of a crankshaft 22. The latter is connected to a driving unit (not shown) by means of a round or a V-belt; the needle bar frame 20 can be turned around a pin 26. Laterial swinging movement of the frame 20 in a plane perpendicular to the shaft 22 is controlled by means of a control disc 30 through a lever-type mechanism 28. Control is performed by means of an external groove 32 on the disc 30, indicated in FIG. 1 by dashed lines.

Alternating movement of a base plate 34 carrying the cloth is to be performed perpendicular to the swinging plane of the frame 20; this is also controlled by the disc 30, control being performed by an internal groove 36 of the disc 30 (see FIG. 1). The base plate 34 is connected to the groove 36 through an adjusting mechanism 38.

Figure 2:
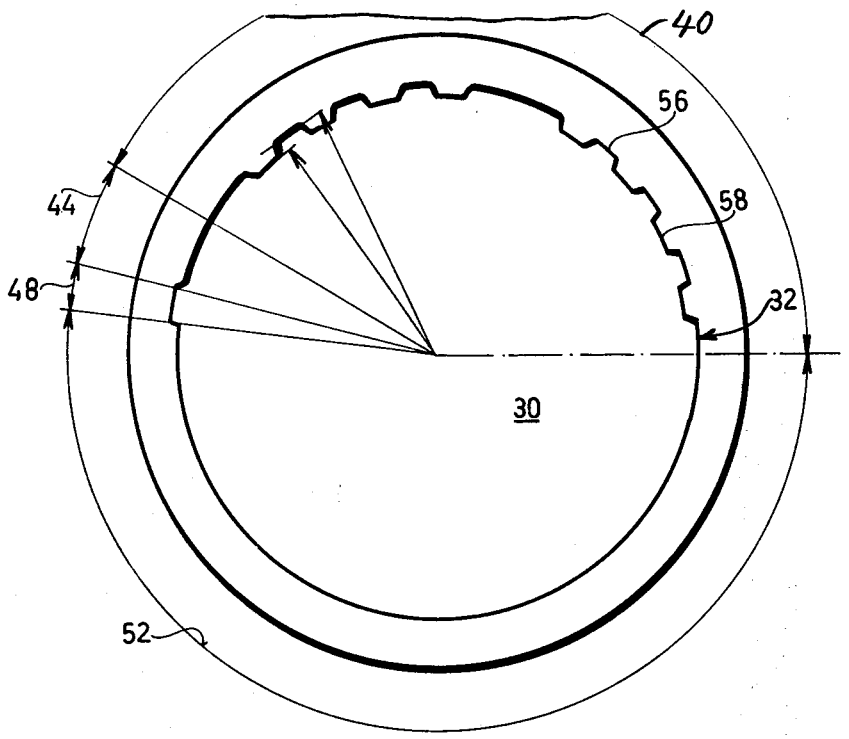
FIG. 2 is a plan view illustrating a preferred embodiment of the path controlling a needle swinging device in the inventive machine.
Figure 3:
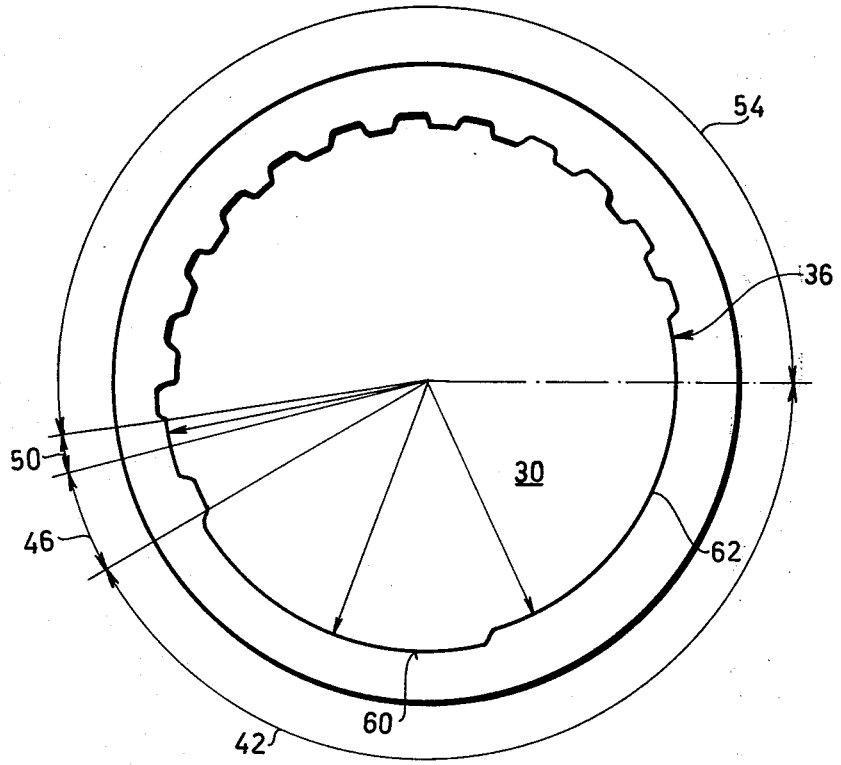
FIG. 3 is a simple plan view illustrating the path controlling a cloth moving mechanism.

Details of the control disc 30 are illustrated in FIGS. 2, 3. In the preferred, exemplary embodiment according to the invention the control paths of the disc 30, formed as the grooves 32, 36, are composed of main sections 40, 42 conjugated to each other for controlling the button stitching, of main sections 44, 46 for controlling the fixing stitches, of special sections 48, 50 for controlling a through-stitching process, as well as of main sections 52, 54 for controlling the shank formation. The main sections 40, 42, respectively, incorporate external subsections 56, 60 and internal subsections 58, 62.

The radius of curvature of the section 48 is greater than that of the subsection 56 of the main section 40 that controls the button stitching.

A solution is also feasible in which the radius of curvature of the section 48 is smaller than that of the inner subsection 58. In the embodiment here described, the radius of the section 50 equals that of the outer subsection 60 of the main section 42 that controls the button stitching.

It is also possible to set the radius of curvature of section 50 so that it conforms to that of the internal subsection 62.

The control disc 30 (FIG. 1) is driven by the crankshaft 22 by means of worm wheels 64, 66. On the base plate 34, that carries the cloth a button turning shaft 68 is supported in bearings. The movement of the shaft 68 is synchronized with the alternating movement of the base plate 34, and the shaft is arranged so that it is rotated about an axis that is perpendicular to the swinging plane of the frame 20. On the outer frontal surface of the disc 30 the groove 32 is machined into which is engaged by a roller 74 of a single-armed lever 72.

The movement of the latter lever 72, controlled by a control groove 70, is transmitted through a carrier bar 76 and a gear rack 78 to a gear 80 arranged on the shaft 68. The end of the button turning shaft 68, lying in the direction of the needle, is connected in a known way to a button clamping device 82. By this arrangement the distance between the cloth and the button, consequently the length of the shank, can also be altered.

Furthermore, the machine is provided with known devices for controlling the thread-cutting and -drawing processes. The material is clamped onto the base plate 34 by a clamping arm 84 which is supported in bearings in the direction of the alternating movement in a fixed manner and pivotally supported in a plane parallel to the swinging path of the frame 20. The arm 84 is pressed onto the cloth by means of a roller 88 loaded by a compression spring 86. After having completed the button stitching, the arm 84 can be raised by means of a lever 90, aided by a tension spring 92. The lever 90 is connected to a conventional starter pedal which is not illustrated.

A control drum 96 is fixed in a stationary manner on the crankshaft 22, the drum moving a knife-rod 98 in a known manner through a double-armed lever 100 and a lever 104, the latter being provided with a roller 102. On the mantle surface of the drum 96 a control groove 106 is machined with which the roller 102 periodically engages. The engagement becomes possible when a control profile 108, arranged in a stationary manner on the inner frontal surface of the control disc 30, raises an interlocking lever 114 through a lever arm 110 against a spring 112. As a consequence, the arm 104 engages the groove 106 of the drum 96 under the influence of a further spring 116.

The crankshaft 22 moves a loop catch 122 in a known manner by means of bevel gears 118, 121, through a gearbox 120 for changing the angular velocity.

Figure 4:
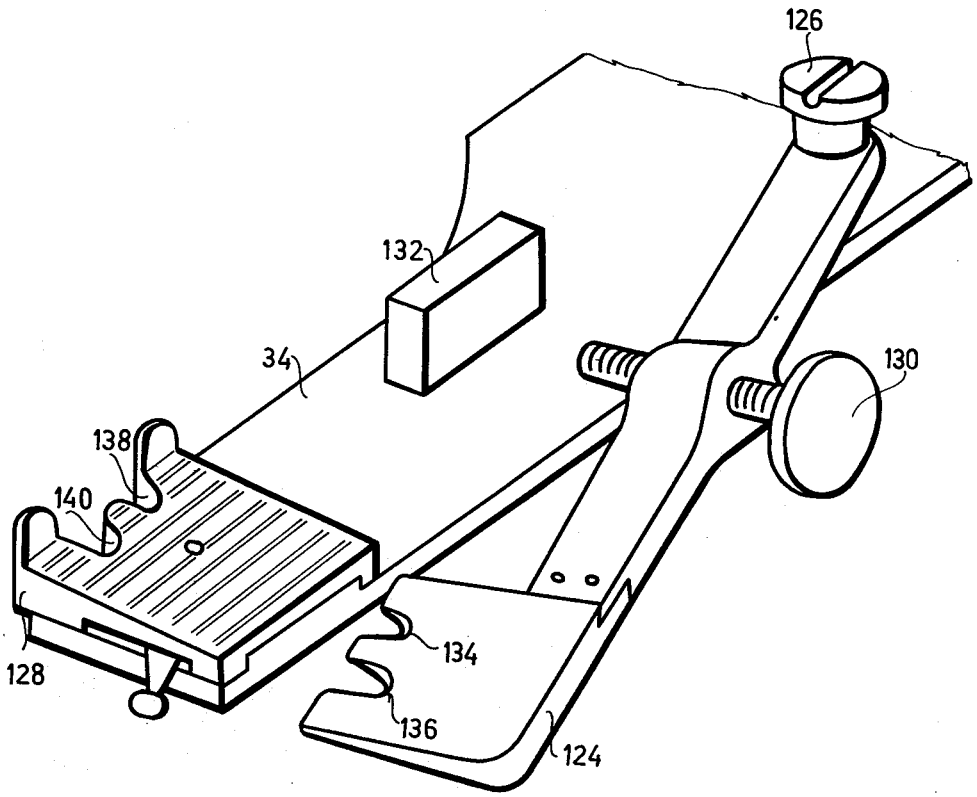
FIG. 4 is a somewhat enlarged perspective view of an orienting mechanism of the machine according to FIG. 1.

On the base plate 34 an orienting plate 124 is arranged which can be rotated around a pivot 126 (FIG. 4). The plate 124, when turned above a supporting profile 128, abuts a buffer 132 fixed onto the plate 34; a set-screw 130 serves for the adjustment of the relative position of the plate 124 and the profile 128. Grooves 134, 136 and 138, 140 that conform to each other are milled into the orienting plate 124 and the supporting profile 128, respectively. Grooves 136, 140 are deeper than grooves 134, 138.

Referring to FIGS. 1 to 4 which illustrate the preferred, exemplary embodiment of the invention, the combined button stitching machine operates as follows. A stretched material, onto which a button is to be sewn, is folded onto the orienting plate 124. This plate is rotated about the pivot 126 in a clockwise direction until it abuts the buffer 132 through the set-screw 130. Hereafter the internally oriented workpiece, to be provided with the buttons, is placed onto the supporting profile 128. Simultaneously with depressing the starting pedal of the machine, the arm 84 clamping the material is lowered unto the workpiece.

After having kept the starter pedal in the depressed state and swung the button clamping device 82 to its horizontal position, the first pair of button holes is sewn by moving the needle bar back and forth. After having accomplished the process described above, the thread cutting device is put into operation, and the first pair of button holes is blind-sewn by reciprocating the needle bar.

Hereafter the thread cutting device is put into operation; the thread pulling mechanism pulls the thread forward for a repeated sewing process. After having advanced the material, the second pair of button holes is blind-sewn by reciprocating the needle; after having finished the button-hole sewing process, the thread is cut and repeatedly pulled forward. Hereafter the button clamping device 82 is led in a vertical plane.

Figure 5:
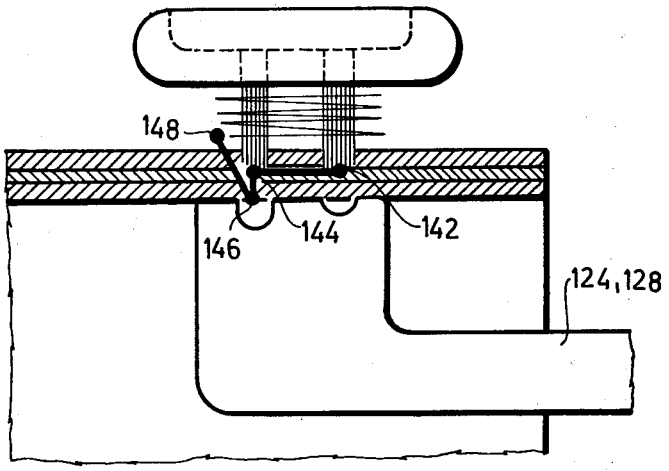
FIG. 5 is a longitudinal section of the mechanism shown in FIG. 4.
Figure 6:
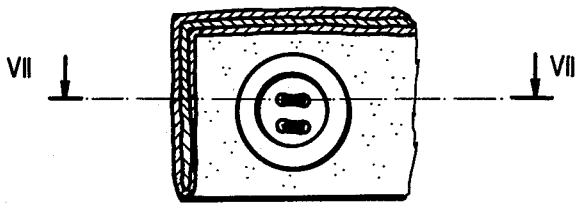
FIG. 6 is a plan view of a button sewn by means of the machine according to this invention.
Figure 7:
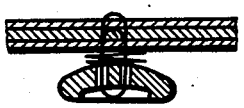
FIG. 7 is a section through the line VII—VII of FIG. 6.
Figure 8:
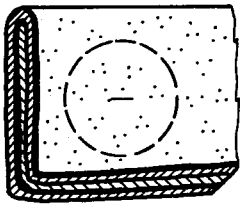
FIG. 8 is a detailed rear view of the button according to FIG. 6.

The button sewing process essentially conforms to the hitherto known processes. After having made two fixing stitches, the lower cloth layer is also through-stitched, representing the inventive concept. The first fixing stitch coincides with a right-side button-sewing stitch (indicated in FIG. 5 by numeral 142), when the button is turned into the vertical plane. Due to the displacement of the base plate 34 a second fixing stitch coincides with a left-hand button-sewing stitch (numeral 144). When performing a through stitch 146, the base plate 34 does not move but the frame 20 with the needles is swung downwards by means of the section 48 that controls the through stitches of the groove 32 on the disc 30. By this stitch the lower cloth layer is securely fixed but without wrinkles.

At a following stitch, indicated by numeral 148, that forms the shank, the needle swings into the middle, while the base plate 34 moves backwards under the influence of the main section 46 of the disc 30; in the next phase further formation of the shank takes place, as usual.

At a lower number of stitches the shank can be formed on the same spot; when the number of stitches is higher and/or at a longer shank, stitching may take place with a certain displacement. By means of a third stitch, through stitching takes place since then the thread does not slip out from the needle but it is still loose enough to fix the lower cloth layer without any wrinkles.

After having finished the shank formation the clamping arm 84 is raised by means of the spring 92, the finished workpiece is removed from the orienting device, and then the cycle may be repeated after having positioned the next workpiece to be provided with buttons.

Summing up what has been described, by using the arrangement according to the invention, combined button stitching with a high quality, and excellent appearance can be achieved, by the aid of which all drawbacks of the known solutions are eliminated.

By using the combined button stitching machine according to the invention, approx. 3500 buttons can be attached in one shift, the number being characteristic for the very high productivity of this machine. Handling requires but one person, consequently preliminary work can be considerably reduced; development of the combined button stitching machine and widening of the "sewing-machine family" becomes possible since the machine according to the invention has been developed by using partial solutions of known machines. Production is considerably cheaper, maintenance and operation are also simpler, resulting in further cost reductions.

It will be understood by those skilled in the art that various modifications, additions, substitutions and other departures from the disclosed particulars can be practiced without departing from the spirit and scope of the present invention.

What we claim is:

1. A conbined button stitching and sewing machine comprising, in combination: a control disc (30) having conjugated paths that control a needle swinging device (20 to 28, 32) and a cloth moving mechanism (36, 38) complete with an orienting device (124 to 128, 134 to 140) for applying a pair of fixing stitches to a button to be attached with a conventional shank to at least one adjacent cloth layer; said control paths of the disc including first main sections (40, 42) for controlling button stitching, second main sections (44, 46) for controlling the fixing stitches, and third main sections (52, 54) for controlling the formation of the shank; wherein fourth sections (48, 50) are inserted in said control paths for controlling through stitches, between said second and said third main sections, whereby an additional cloth layer is through stitched, in addition to the preceding fixing stitches, while avoiding the formation of wrinkles in the cloth layers.

2. The machine as defined in claim 1, wherein said second main sections (44, 46) form part of said control paths and include inner and outer arched subsections (56, 58); one (48) of said fourth sections (48, 50) being also formed with an arch, while an end point of the radius of curvature lies outside an annular bend defined by subsections of said first main sections (40, 42).

3. The machine as defined in claim 1, wherein said second main sections (44, 46) form part of a path that controls said cloth moving mechanism (36, 38) and include inner and outer arched subsections (60, 62); one (50) of said fourth sections (48, 50) being also formed with an arch, while the radius of curvature of the same conforms to one of the radii belonging to subsections of said first main sections (40, 42).

4. The machine as defined in claim 1, wherein said orienting device (124 ... 140) includes a moving (124) and a stationary part (128), the relative positions between said parts being controlled by means of adjusting devices (130, 132).

5. The machine as defined in claim 1, further comprising a base plate (34) for carrying the material being processed; wherein said adjusting devices (130, 132) include a buffer (132) fixed in a stationary manner onto said base plate; and a set-screw (130) connected to said moving part (124) and conjugated to said buffer.

* * * * *